US008280288B2

(12) United States Patent
Aratachi

(10) Patent No.: US 8,280,288 B2
(45) Date of Patent: Oct. 2, 2012

(54) IMAGE FORMING DEVICE HAVING PROTECTION MEMBER FOR PROTECTING PEELING CLAW

(75) Inventor: Tomitake Aratachi, Toyokawa (JP)

(73) Assignee: Brother Kogyo Kabushiki Kaisha, Nagoya-shi, Aichi-Ken (JP)

( * ) Notice: Subject to any disclaimer, the term of this patent is extended or adjusted under 35 U.S.C. 154(b) by 377 days.

(21) Appl. No.: 12/562,796

(22) Filed: Sep. 18, 2009

(65) Prior Publication Data

US 2010/0086332 A1 Apr. 8, 2010

(30) Foreign Application Priority Data

Oct. 8, 2008 (JP) ..... 2008-261313

(51) Int. Cl.
*G03G 15/20* (2006.01)

(52) U.S. Cl. ..... 399/323; 21/22

(58) Field of Classification Search ..... 399/21, 399/22, 323, 399, 124
See application file for complete search history.

(56) References Cited

U.S. PATENT DOCUMENTS

| | | | | |
|---|---|---|---|---|
| 4,571,056 | A * | 2/1986 | Tani et al. | 399/122 |
| 5,159,393 | A * | 10/1992 | Hiroshima et al. | 399/313 |
| 7,616,919 | B2 * | 11/2009 | Aratachi et al. | 399/323 |
| 2006/0177249 | A1 * | 8/2006 | Aratachi et al. | 399/323 |
| 2008/0131177 | A1 | 6/2008 | Aratachi et al. | |

FOREIGN PATENT DOCUMENTS

| | | | |
|---|---|---|---|
| JP | 57-153353 | | 9/1982 |
| JP | 07-084421 | | 3/1995 |
| JP | 2002-003042 | | 1/2002 |
| JP | 2003-255748 | | 9/2003 |
| JP | 2003255748 | A * | 9/2003 |
| JP | 2008-158245 | | 7/2008 |
| JP | 2008-158507 | | 7/2008 |

OTHER PUBLICATIONS

Machine Translation of JP-2003-255748.*
Machine Transation of JP 2002-003042.*
Office Action in corresponding Japanese Patent Application 2008-261313 mailed Aug. 31, 2010.
Office Action for corresponding Japanese Application 2008-261313 mailed on Jun. 16, 2010.

* cited by examiner

*Primary Examiner* — David Gray
*Assistant Examiner* — G.M. Hyder
(74) *Attorney, Agent, or Firm* — Banner & Witcoff, Ltd.

(57) ABSTRACT

An image forming device includes a frame, a photosensitive drum, a developing roller, a transfer roller, a heating roller, a backup roller, a peeling claw, and a protection member. The photosensitive drum has a surface on which a latent image is formable. The developing roller develops the latent image to provide a toner image. The transfer roller transfers the toner image onto a recording medium. The heating roller has a heating surface and a shaft supported to the frame and extending in a direction. The backup roller has a shaft supported to the frame and extending in the direction. The backup roller is in pressure contact with the heating roller. The peeling claw has a tip end in sliding contact with the heating surface of the heating roller. The protection member is configured to protect the peeling claw and prevent a user from accessing to the peeling claw.

8 Claims, 6 Drawing Sheets

IMAGE FORMING DEVICE HAVING PROTECTION MEMBER FOR PROTECTING PEELING CLAW

CROSS REFERENCE TO RELATED APPLICATION

This application claims priority from Japanese Patent Application No. 2008-261313 filed Oct. 8, 2008. The entire content of the priority application is incorporated herein by reference.

TECHNICAL FIELD

The invention relates to a fixing device capable of fixing an image formed of developing agent onto a sheet-type recording medium. More specifically, the invention relates to arrangements in the vicinity of the fixing device.

BACKGROUND

Conventionally, an electrophotographic image forming device is provided with a fixing device. The fixing device is so as to be capable of fixing a toner image onto a sheet of paper. The fixing device includes a heating roller and a pressure roller disposed opposite to the heating roller.

A conveying roller pair is disposed in a downstream side of the heating roller and the pressure roller in a paper conveying direction to convey the sheet further towards the downstream side. A paper separating claw is provided to separate the sheet from the heating roller.

SUMMARY

In order to downsize the image forming device, it is necessary to downsize the fixing device. However, downsizing of the fixing device tends to cause a paper jam.

Accordingly, it is desirable that, when a paper jam has occurred in the fixing device, jammed paper be easily removed from the fixing device without damaging the same.

In view of the foregoing, it is an object of the invention to provide an image forming device. The image forming device includes a frame, a photosensitive drum, a developing roller, a transfer roller, a heating roller, a backup roller, a peeling claw, and a protection member. The photosensitive drum has a surface on which a latent image is formable. The developing roller develops the latent image to provide a toner image. The transfer roller transfers the toner image onto a recording medium. The heating roller has a heating surface and a shaft supported to the frame and extending in a direction. The backup roller has a shaft supported to the frame and extending in the direction. The backup roller is in pressure contact with the heating roller. The peeling claw has a tip end in sliding contact with the heating surface of the heating roller. The protection member is configured to protect the peeling claw and prevent a user from accessing to the peeling claw.

BRIEF DESCRIPTION OF THE DRAWINGS

The particular features and advantages of the invention as well as other objects will become apparent from the following description taken in connection with the accompanying drawings, in which.

DETAILED DESCRIPTION

<Overall Structure of Laser Printer>

Figure 1:
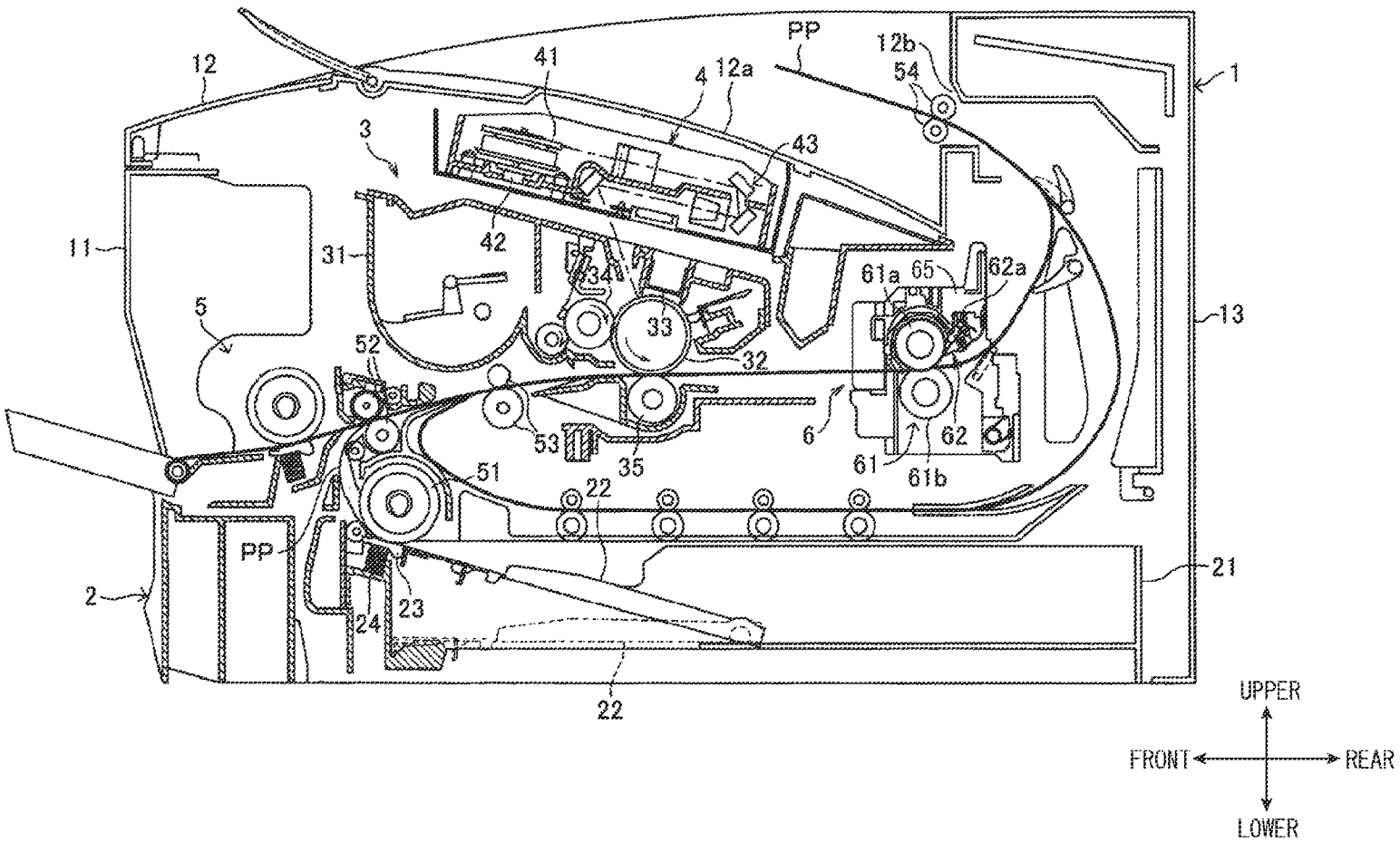
FIG. 1 is a schematic cross-sectional view of a laser printer embodying an image forming device according to an embodiment of the invention.

A laser printer 1 as an image forming device according to an embodiment of the invention will be described with reference to FIG. 1. As shown in FIG. 1, the laser printer 1 is configured to form a toner image on a sheet of paper while conveying the sheet along a paper conveying path PP. A direction of paper to be conveyed along the paper conveying path PP will hereinafter be referred to as "paper conveying direction."

Throughout the specification, the terms "above", "below", "right", "left", "front", "rear" and the like will be used assuming that the laser printer 1 is disposed in an orientation in which it is intended to be used. More specifically, in FIG. 1 a left side and a right side are a front side and a rear side, respectively.

A paper width direction is defined by a direction perpendicular to a frontward/rearward direction of the laser printer 1 and a hightwise direction of the laser printer 1.

The laser printer 1 has a main casing 11. Within the main casing 11, provided are a feeder unit 2, a process cartridge 3, a scanner unit 4, a sheet conveying unit 5 and a fixing unit 6.

The feeder unit 2 is positioned at a lower portion of the main casing 11. The feeder unit 2 is mountable to detachable from the main casing 11 in a frontward/rearward direction.

The process cartridge 3 is detachably mounted in the main casing 11. The process cartridge 3 forms a toner image on a sheet of paper in cooperation with the scanner unit 4.

The sheet conveying unit 5 conveys the sheet along the paper conveying path PP. The fixing unit 6 fixes the toner image on the sheet.

Each part of the laser printer 1 will be described below in detail.

<<Main Body>>

The main casing 11 is formed substantially in a box shape. The main casing 11 integrally formed of resin is formed over an outer surface of a main frame (not shown) for supporting various parts and components mounted in the main casing 11.

A top cover 12 is formed with a concave portion of which depth is gradually decreased towards the front side of the top cover 12. The concave portion has a bottom surface constituting a discharge tray 12*a* to accommodate the image-bearing sheets. Specifically, the discharge tray 12*a* is defined by a slant surface extending from the front side of the top cover 12 diagonally downward towards the rear side of the top cover 12.

An upper rear end of the discharge tray 12*a* is formed with a discharge opening 12*b*. The discharge tray 12*a* is so configured as to be capable of receiving the image-bearing sheets discharged from the discharge opening 12*b*.

A rear cover 13 is movable between an open position and a closed position. When the rear cover 13 is at the open position, the fixing unit 6 is exposed to allow a user to access the same. By opening the rear cover 13, a user can remove jammed paper from the fixing unit 6 when a paper jam has occurred in the fixing unit 6.

<<Feeder Unit>>

The feeder unit 2 has a feeder casing 21. The feeder casing 21 is capable of accommodating a plurality of stacked sheets of paper therein. The feeder casing 21 includes a sheet pressing plate 22, a separation pad 23, and a coil spring 24 allowing the separation pad 23 to urge against a sheet supply roller 51.

The sheet pressing plate 22 has front and rear ends. The rear end of the sheet pressing plate 22 is fixed to a bottom surface of the feeder casing 21 to move pivotally about the same. The front end of the sheet pressing plate 22 is urged upward when supplying the sheet.

The separation pad 23 is positioned immediately frontward of the sheet pressing plate 22, and disposed at a downstream side of the sheet pressing plate 22 in the paper conveying direction. An upper surface of the separation pad 23 is formed of material having a friction coefficient higher than paper, such as rubber. The coil spring 24 is positioned immediately below the separation pad 23 to urge the separation pad 23 upward.

<<Process Cartridge>>

The process cartridge 3 has a process casing 31. Within the process casing 31, provided are a photosensitive drum 32, a charger 33, a developing roller 34, and a transfer roller 35.

The photosensitive drum 32 is a cylindrical member formed with a photosensitive layer at its outer peripheral surface. The photosensitive drum 32 is rotatable about an axis parallel to the paper width direction as indicated by an arrow in FIG. 1.

The charger 33 is disposed above the photosensitive drum 32 and opposes the outer peripheral surface of the photosensitive drum 32. The charger 33 is configured to uniformly charge the outer peripheral surface of the photosensitive drum 32.

The developing roller 34 is rotatably disposed frontward with respect to the photosensitive drum 32. The developing roller 34 is rotatable in a direction indicated by an arrow in FIG. 1, so as to supply charged toner onto the outer peripheral surface of the photosensitive drum 32.

The transfer roller 35 is disposed opposite to the photosensitive drum 32 across the paper conveying path PP. The transfer roller 35 rotates in a direction opposite to a rotational direction of the photosensitive drum 32. Further, a predetermined voltage is applied to the transfer roller 35 so as to transfer a toner image formed on the outer peripheral surface of the photosensitive drum 32 onto the sheet of paper.

<<Scanner Unit>>

The scanner unit 4 is disposed above the process casing 31. The scanner unit 4 includes a polygon mirror 41, a motor 42, and an optical system 43.

The polygon mirror 41 is operatively coupled to a rotational drive shaft of the motor 42. While drivingly rotated by the polygon motor 42, the polygon mirror 41 deflects with its one facet a laser beam generated from a laser generating unit (not shown), thereby scanning over the outer peripheral surface of the photosensitive drum 32 with the laser beam.

The optical system 43 includes an f-θ lens, a cylindrical lens, a reflecting mirror and the like. The optical system 43 functions to compensate for scanning intervals and the cross sectional shape of the laser beam deflected by the polygon mirror 41.

<<Sheet Supply Unit>>

The sheet conveying unit 5 includes the sheet supply roller 51, a conveying roller 52, a registration roller 53, and a discharge roller 54. The sheet conveying unit 5 is configured to convey the sheet along the paper conveying path PP.

The sheet supply roller 51 is rotatably supported at a lower portion of the main casing 11. The sheet supply roller 51 is disposed above the separation pad 23 and opposes the separation pad 23, so that edge portions of the sheets accommodated in the feeder casing 21 are brought into contact with the sheet supply roller 51. The sheet supply roller 51 picks up each sheet accommodated in the feeder unit 2 in cooperation with the separation pad 23 so as to convey the sheet toward the conveying roller 52.

The conveying roller 52 is provided at a position downstream of the sheet supply roller 51. The conveying roller 52 conveys the sheet picked up by the sheet supply roller 51 towards the registration roller 53.

The registration roller 53 is provided at a position upstream of a transfer position (a position that the photosensitive drum 32 opposes the transfer roller 35) in the paper conveying direction. While adjusting an orientation and conveying timing of the sheet, the registration roller 53 supplies the sheet towards the transfer position.

The discharge roller 54 is positioned frontward of the discharge opening 12*b* so as to allow the sheet past the fixing unit 6 to discharge onto the discharge tray 12*a*.

<<Fixing Unit>>

The fixing unit 6 is provided at a position downstream of the above transfer position. That is, the fixing unit 6 is disposed at a rear side of the main casing 11 of the laser printer 1.

The fixing unit 6 includes a fixing roller pair 61. The fixing roller pair 61 includes a heating roller 61*a* and a backup roller 61*b*. The heating roller 61*a* has a heating surface, and a shaft supported to a main fixing unit frame 65 and extending in a direction parallel to the paper width direction. The heating roller 61*a* heats toner deposited on the sheet. Further, the heating roller 61*a* is of a hollow cylindrical shape made of metal, in which a heater is accommodated to generate heat.

The backup roller 61*b* has a shaft supported to the main fixing unit frame 65 and juxtaposed with the shaft of the heating roller 61*a*. Further, the backup roller 61*b* is disposed opposite to the heating roller 61*a* interposing the paper conveying path PP therebetween. The backup roller 61*b* includes a roller portion made of silicon rubber, and is in pressure contact with the heating roller 61*a*.

A peeling claw 62 is provided at a position downstream of the fixing roller pair 61 in the paper conveying direction. The peeling claw 62 has a tip end in sliding contact with the heating surface of the heating roller 61*a* so as to peel the sheet off from the heating surface of the heating roller 61*a* with its tip end. Further, the peeling claw 62 is rotatably movable about a pivot shaft 62*a* positioned at an end opposite to the tip end, and is also linearly movable in an upward/downward direction. The tip end of the peeling claw 62 is movable towards and away from the heating surface of the heating roller 61*a*. A plurality of the peeling claws 62 (four peeling claws in this embodiment) is disposed substantially at an equi-pitch in the paper width direction.

A conveying roller pair 63 conveys the sheet to be away from the fixing roller pair 61. The conveying roller pair 63 includes a drive roller 63*b* supported on a drive shaft 63*a* and a driven roller 63*d* disposed in pressure contact with the drive roller 63*b*. A plurality of the conveying roller pairs 63 (four pairs in this embodiment) is disposed substantially at an equi-pitch along the drive shaft 63*a*.

Figure 2:
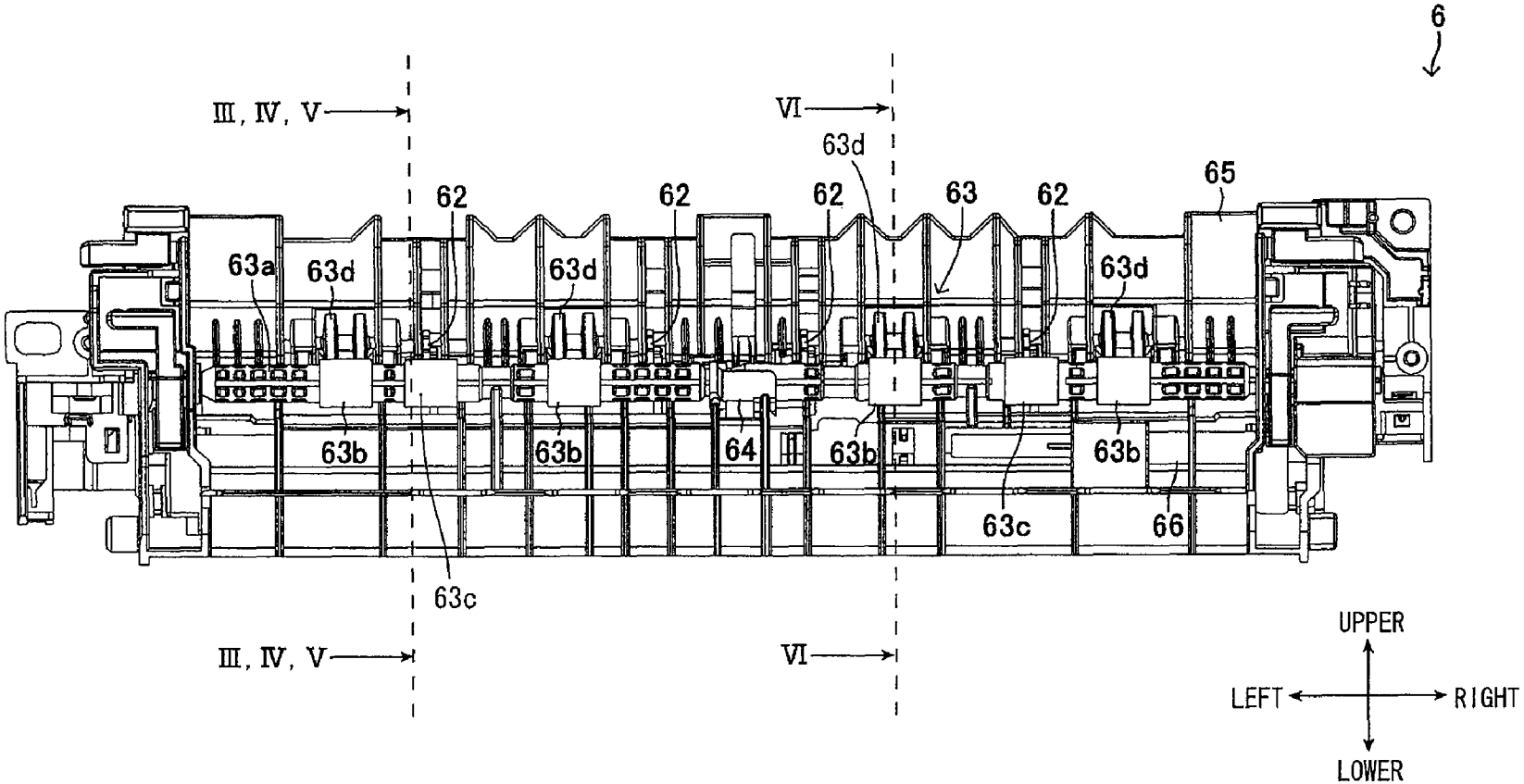
FIG. 2 is a view showing a rear side of a fixing unit in the laser printer shown in FIG. 1.
Figure 3:
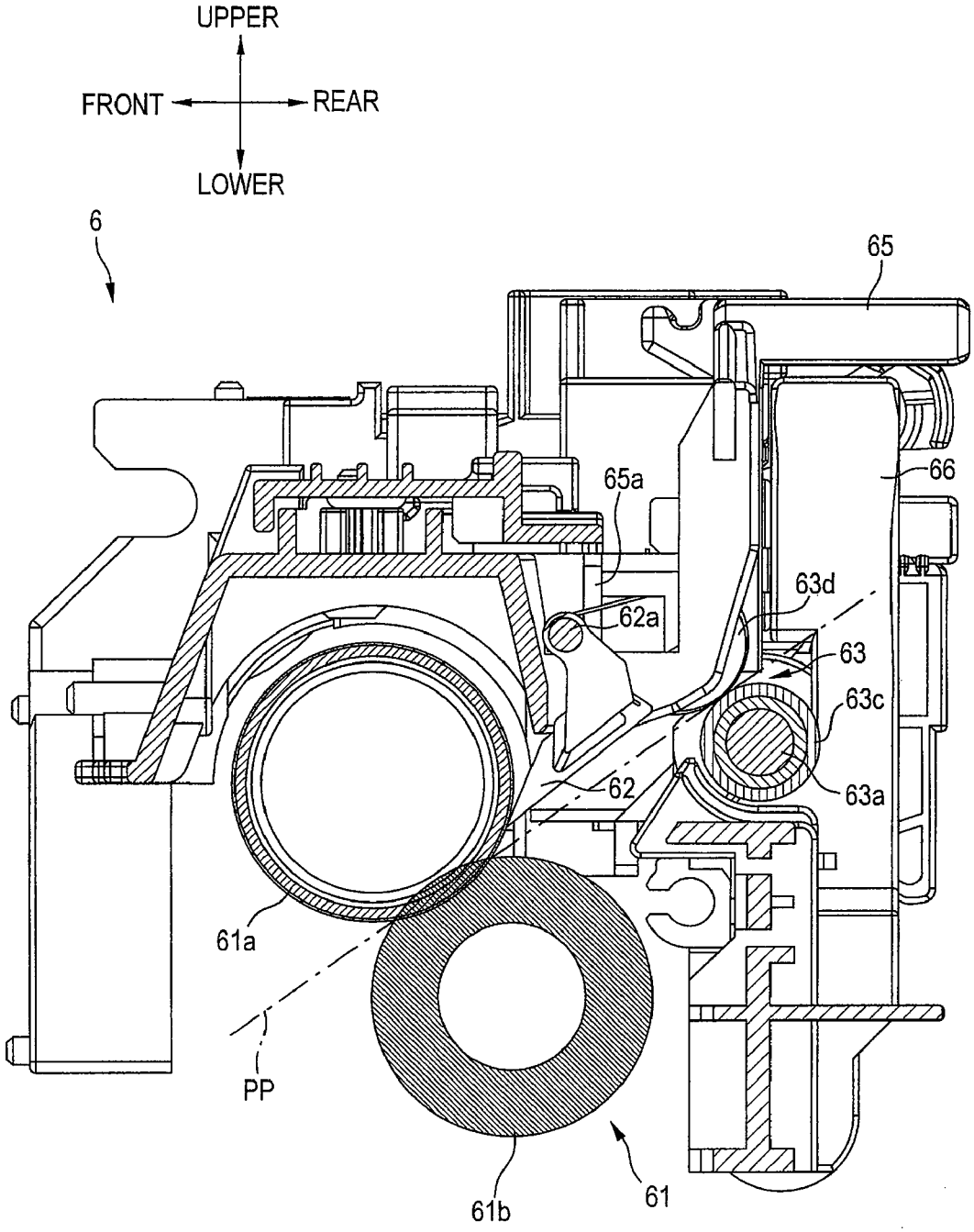
FIG. 3 is an enlarged cross-sectional view showing the fixing unit shown in FIG. 1.

As shown in FIG. 3, the drive shaft 63*a* is positioned below the paper conveying path PP. Rotations of the drive shaft 63*a* convey the sheet in the sheet conveying direction. As shown in FIG. 2, the drive shaft 63*a* extends in the paper width direction, and has a first end and a second end. The first and second ends are rotatably supported to a sub fixing unit frame 66. Further, the drive shaft 63*a* is rotatably supported by a bearing 64 provided substantially at an intermediate position between the first end and the second end.

The drive roller 63*b* is formed with a cylindrical member made of rubber, that is, a rubber roller. The drive roller 63*b* is fixed to the drive shaft 63*a* so as to coaxially rotatable therewith.

As shown in FIG. 2, a peeling claw opposing roller 63*c*, which functions as a protection member with respect to the peeling claw 62, is coaxially provided on the drive shaft 63*a*. The peeling claw opposing roller 63*c* is fixed to the drive shaft 63*a* so as to rotatable therewith. The peeling claw opposing roller 63*c* is disposed in confrontation with the peeling claw 62. The peeling claw opposing roller 63*c* is positioned below the paper conveying path PP, while the peeling claw 62 is positioned above the paper conveying path PP.

The peeling claw opposing roller 63*c* is formed with a cylindrical member made of rubber, that is, a rubber roller.

A plurality of the peeling claw opposing rollers 63*c* (two rollers in this embodiment) is provided at a position where a flexure amount of the drive shaft 63*a* is larger. In this embodiment, one peeling claw opposing roller 63*c* is provided at an intermediate position between the first end and the bearing 64, and another peeling claw opposing roller 63*c* at an intermediate position between the bearing 64 and the second end. In other words, the peeling claw opposing roller 63*c* is not provided at a position where the flexure amount of the drive shaft 63*a* is not relatively large, for example, at a position in confrontation with the peeling claw 62 positioned closer to the bearing 64. The four drive rollers 63*b* is provided in the embodiment. That is, the first drive roller 63*b* is disposed between the first end and one peeling claw opposing roller 63*c* that is provided at the intermediate position between the first end and the bearing 64. The second drive roller 63*b* is disposed between the bearing and the one peeling claw opposing roller 63*c* that is provided at the intermediate position between the first end and the bearing 64. The third drive roller 63*b* is disposed between the bearing 64 and another peeling claw opposing roller 63*c* that is provided at the intermediate position between the bearing 64 and the second end. The fourth drive roller 63*b* is disposed between the second end and another peeling claw roller 63*c* that is provided at the intermediate position between the bearing 64 and the second end.

The peeling claw opposing roller 63*c* is provided to reduce an open space formed between the peeling claw 62 and the drive shaft 63*a* in the frontward/rearward direction as well as to protect the peeling claw 62 to prevent the user from accessing to the peeling claw 62.

The driven roller 63*d* is supported to the main fixing unit frame 65, and rotatable in association with rotations of the drive roller 63*b*. The driven roller 63*d* is positioned above the paper conveying path PP.

The driven roller 63*d* and the peeling claw 62 are disposed in positions offset from each other in the paper width direction. Further, as shown in FIGS. 3 to 5, the peeling claw 62 overlaps at least partially with the driven roller 63*d* when projected onto a plane perpendicular to the paper width direction regardless of a position of the peeling claw 62.

Figure 4:
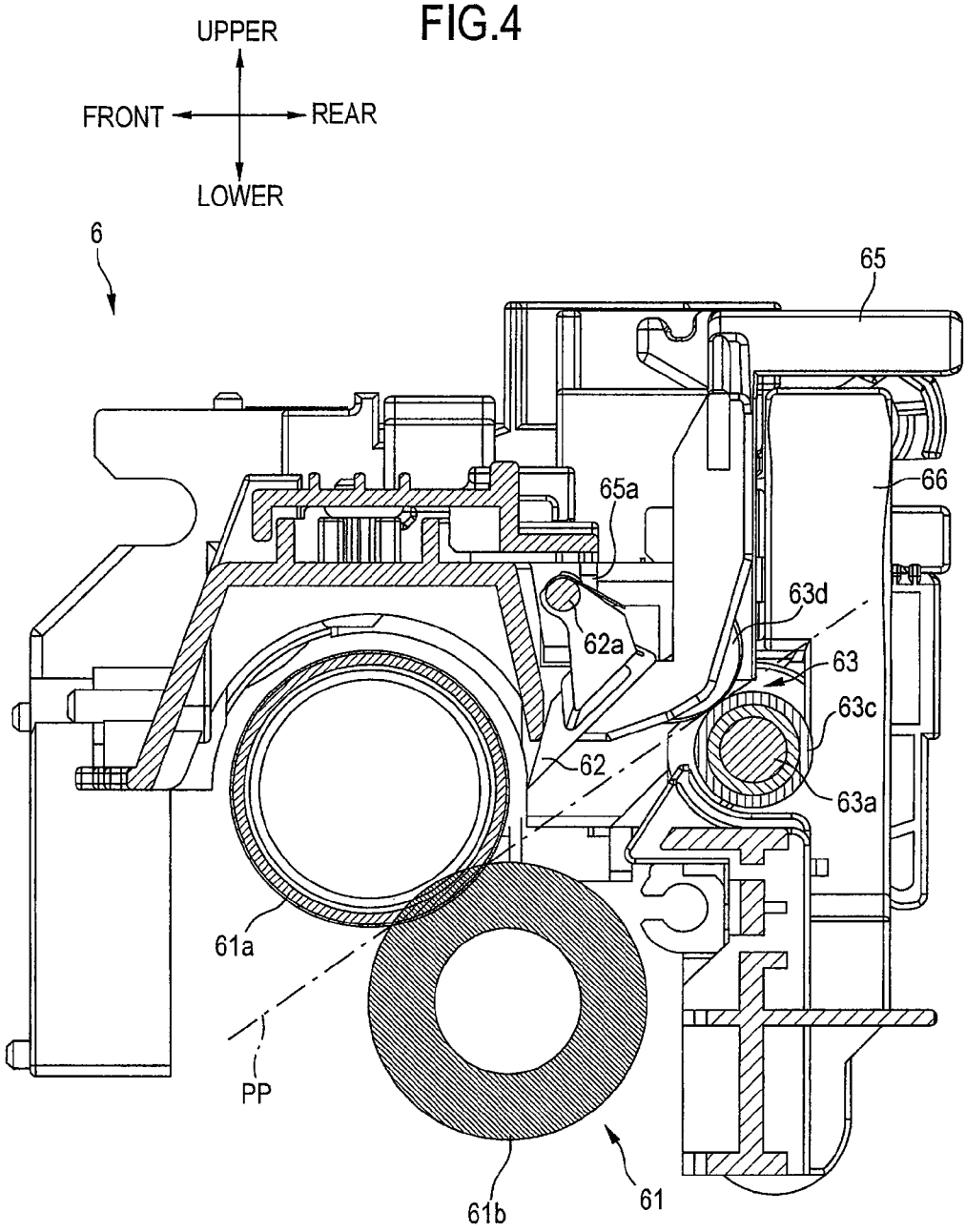
FIG. 4 is an enlarged cross-sectional view showing the fixing unit shown in FIG. 1.
Figure 5:
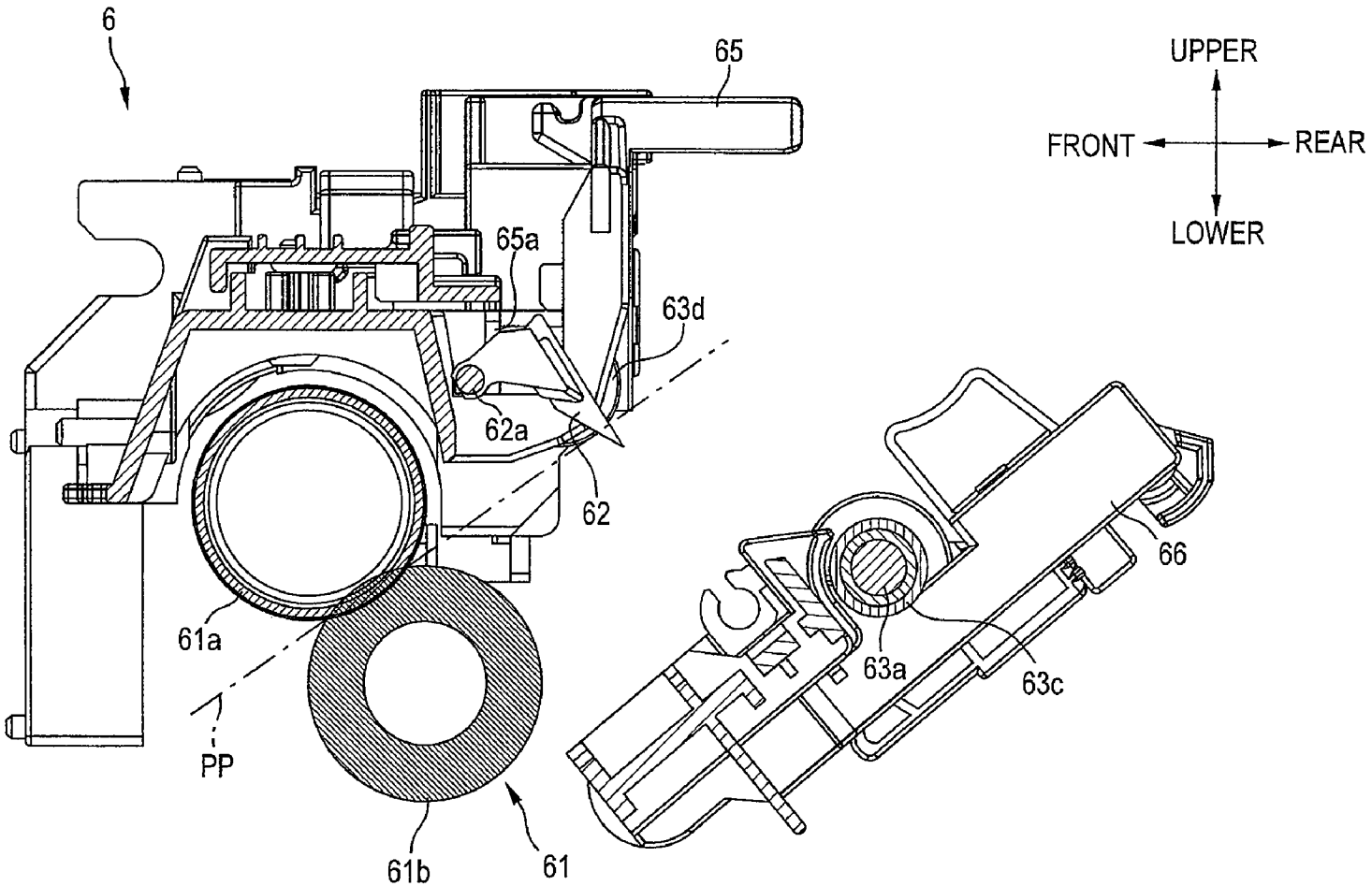
FIG. 5 is an enlarged cross-sectional view showing the fixing unit shown in FIG. 1.

As shown in FIGS. 3 to 5, the main fixing unit frame 65 is provided with a peeling claw supporting portion 65*a*. The peeling claw supporting portion 65*a* is of a generally U-shaped shape. The peeling claw supporting portion 65*a* is engageable with the pivot shaft 62*a* so as to allow the peeling claw 62 to be rotatably movable about the pivot shaft 62*a* and to be upwardly and downwardly movable.

Figure 6:
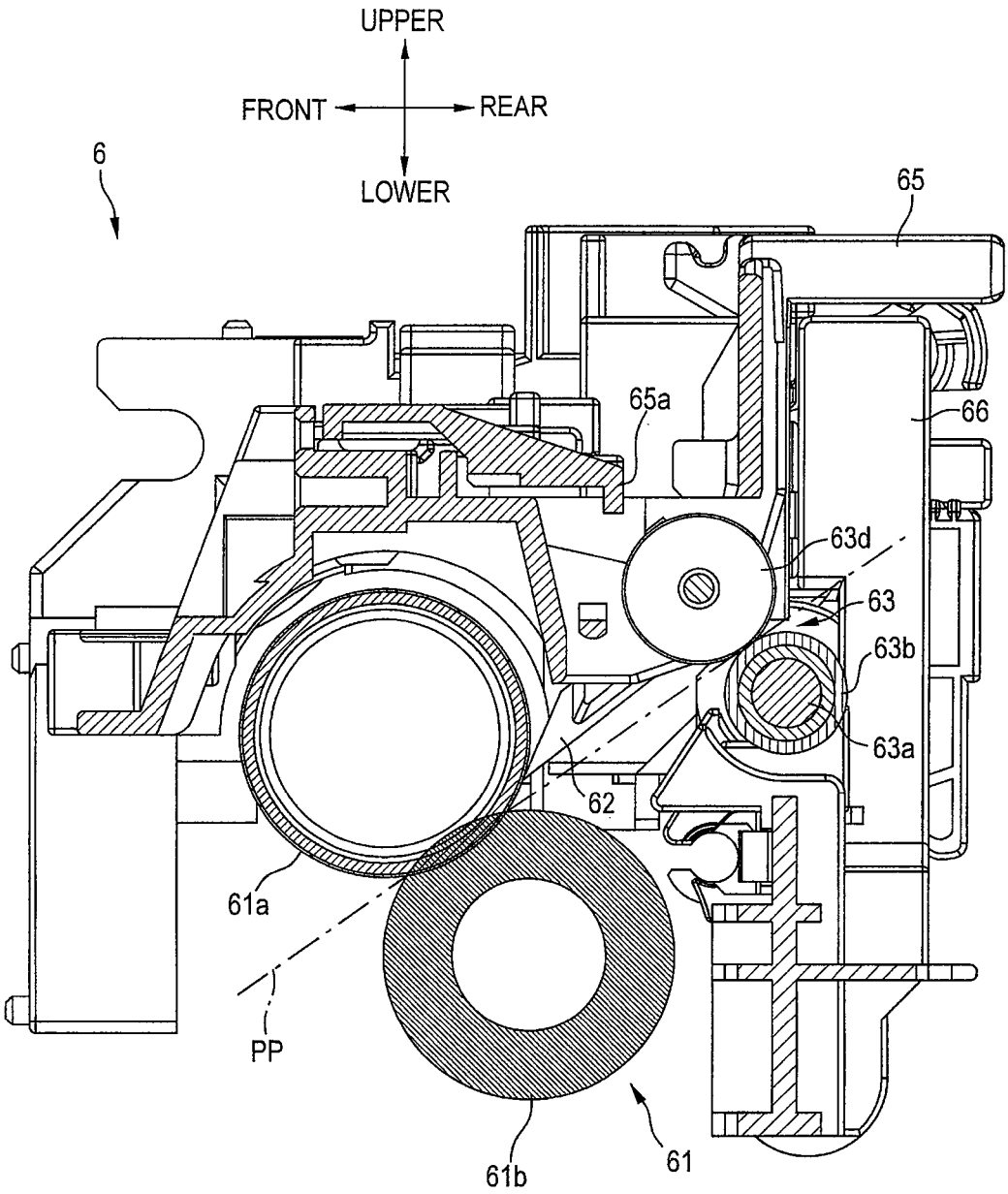
FIG. 6 is an enlarged cross-sectional view showing the fixing unit shown in FIG. 1 of which the cross section is different from that of the views of FIGS. 3 to 5.

As shown in FIG. 6, the main fixing unit frame 65 further includes a stopper 65*b*. According to the embodiment, the driven roller 63*d* is removably provided with respect to the drive roller 63*b*. The stopper 65*b* is provided to regulate a displacement amount of the driven roller 63*d* in a direction removing from the drive roller 63*b* (in a diagonally upward and frontward direction in FIG. 6).

The sub fixing unit frame 66 supports the drive shaft 63*a* by fixing the first end, the second end and the bearing 64 thereto. As shown in FIGS. 4 and 5, the sub fixing unit frame 66 has a lower portion provided with a shaft extending in the paper width direction, and is pivotably movable between a closed position and an open position about the shaft with respect to the main fixing unit frame 65.

<<Operation of Laser Printer>>

An operation of the laser printer 1 having the structure as described above will be described while referring to FIG. 1.

<<Sheet Supply Operation>>

The edge portions downstream in the paper conveying direction of the stacked sheets of paper accommodated in the feeder casing 21 are urged upwardly towards the sheet supply roller 51 by the sheet pressing plate 22, so that a first few sheets from the top of the stacked paper are brought into contact with a peripheral surface of the sheet supply roller 51.

In this state, when the sheet supply roller 51 is rotated, the edges of the sheets are conveyed to be pinched between the sheet supply roller 51 and the separation pad 23. Only the topmost sheet being in contact with the peripheral surface of the sheet supply roller 51 is supplied to the conveying roller 52 in association with rotation of the sheet supply roller 51.

The leading edge of the sheet conveyed in the paper conveying direction by the conveying roller 52 impinges against the registration roller 53. The resist roller 53 is provided to compensate for the orientation of the sheet. Then, rotation of the registration roller 53 at predetermined timing allows the sheet to be conveyed to the transfer position where the photosensitive drum 32 opposes the transfer roller 35.

<<Toner Image Forming>>

While the sheet is conveyed to the transfer position as described above, a toner image is formed on the outer peripheral surface of the photosensitive drum 32 as described below.

The outer peripheral surface of the photosensitive drum 32 is uniformly charged by the charger 33. While the outer peripheral surface of the photosensitive drum 32 charged by the charger 33 moves towards the downstream side in the rotational direction of the photosensitive drum 32, the charged surface of the photosensitive drum 32 is irradiated with the laser beam. The laser beam is modulated according to image data. By scanning the modulated laser beam over the outer peripheral surface of the photosensitive drum 32, an electrostatic latent image is formed on the outer peripheral surface of the photosensitive drum 32.

The outer peripheral surface of the photosensitive drum 32 on which the electrostatic latent image is formed reaches a position opposite to an outer peripheral surface of the developing roller 34. Here, the outer peripheral surface of the photosensitive drum 32 is brought into contact with or brought to a position closer to the outer peripheral surface of the developing roller 34 on which the charged toner is deposited. The toner is deposited on the peripheral surface of the photosensitive drum 32 to form a toner image corresponding to the electrostatic latent image. That is, the electrostatic latent image formed on the outer peripheral surface of the photosensitive drum 32 is developed by the toner.

The toner image formed on the peripheral surface of the photosensitive drum 32 as described above is transferred onto the sheet at the transfer position.

<<Fixing & Discharging>>

The sheet on which the toner image is transferred is conveyed to the fixing unit 6 along the paper conveying path PP. The sheet is fed between the heating roller 61*a* and the backup roller 61*b* to be pressed and heated, and therefore, the toner image is thermally fixed on the sheet. Subsequently, the sheet is conveyed to the discharge roller 54, and discharged from the discharge opening 12*b* to the discharge tray 12*a*.

<<Operation and Effect According to Embodiment>>

Next, operations and effects according to the embodiment will be described while referring to FIGS. 1 to 6.

According to the embodiment, the peeling claw 62 overlaps at least partially with the driven roller 63*d* when projected onto a plane perpendicular to the paper width direction regardless of a position of the peeling claw 62. Accordingly, downsizing of the fixing unit 6 can be attained.

A paper jam may occur at a position between the fixing roller pair 61 and the conveying roller pair 63. Such a paper jam tends to occur as the fixing unit 6 is downsized. According to the embodiment, as shown in FIGS. 4 and 5, the peeling claw 62 is pivotally movable and upwardly slidable. Accordingly, damages on the surface of the heating roller 61*a* caused by the tip end of the peeling claw 62 can be prevented as much as possible when the paper jam has occurred.

If such a paper jam has occurred, a user opens the rear cover 13 to remove the jammed paper. In case a relatively minor paper jam has occurred, the jammed paper is removed from the fixing unit 6 in a state that the sub fixing unit frame 66 is in the closed position.

According to the embodiment, the peeling claw opposing roller 63*c* is provided to reduce an open space formed between the peeling claw 62 provided at a position where a flexure amount of the drive shaft 63*a* is larger and the drive shaft 63*a*, and to protect the peeling claw 62 to prevent the user from accessing to the peeling claw 62.

When removing the jammed paper, the user may insert his fingers in the open space formed between the peeling claw 62 and the drive shaft 63*a* to remove the jammed paper. In such a situation, fingers of the user may accidentally press the peeling claw 62 against the heating roller 61*a*, thereby damaging the surface of the heating roller 61*a* with the peeling claw 62. Further, foreign material may be introduced into a portion around the peeling claw 62, in particular, around the pivot shaft 62*a*. According to the embodiment, such problems can be prevented by the peeling claw opposing roller 63*c* as much as possible, since the peeling claw opposing roller 63*c* minimizes the open space formed between the peeling claw 62 and the drive shaft 63*a*. Accordingly, the jammed paper can be appropriately removed.

In case a serious paper jam has occurred and foreign material or a small piece of paper remains inside the fixing unit 6, the jammed paper is removed from the fixing unit 6 in a state that the sub fixing unit frame 66 is in the open position, as shown in FIG. 5.

<<Illustration of Modification>>

While the invention has been described in detail with reference to the embodiment thereof, it would be apparent to those skilled in the art that various changes and modifications may be made therein without departing from the spirit of the invention.

(1) The invention is not limited to be applied to a monochromatic laser printer. For example, the invention may be applied to an electrophotographic type color laser printer, monochromatic copying machine and color copying machine. Further, in the above embodiment, the photosensitive drum is employed. However, a flat plate type photosensitive member and an endless belt type photosensitive member are also available.

Further, with regard to the configuration of the feeder unit 2, process cartridge 3 and the scanner unit 4, various configurations may be adopted other than the configuration described above. For example, the invention may be applied to an image forming device in which the feeder unit 2 is omitted and sheets of paper are only fed manually.

The invention is applicable to an image forming device of toner jet type, an ion flow type and a multi-stylus electrode type, other than the electrophotographic type image forming device.

(2) The configurations of the heating roller and the backup roller according to the invention are not limited to ones as described above. For example, instead of the heating roller 61*a*, a sleeve type fixing film made of rubber or synthetic resin may be used. If this is the case, a heating unit such as a ceramic heater is provided inside the fixing film so that the opposing roller (a pressure roller) is opposite to the heating unit interposing the fixing film therebetween. The heating unit extends along the paper width direction (an axial direction of the above sleeve) with a length corresponding to a maximum paper width.

(3) The peeling claw opposing roller 63*c* may be formed of a material different from that of the drive roller 63*b*. More specifically, the peeling claw opposing roller 63*c* may be formed of synthetic resin (preferably fluororesin).

The peeling claw opposing roller 63*c* may be rotatable relative to the drive shaft 63*a* and the drive roller 63*b*. That is, the peeling claw opposing roller 63*c* may be supported by the drive shaft 63*a* to rotate about the drive shaft 63*a*.

(4) Four peeling claws 62 are provided in the embodiment. However, the number of the peeling claw 62 is not limited to four.

What is claimed is:

1. An image forming device comprising:

a frame;

a photosensitive drum having a surface on which a latent image is formable;

a developing roller configured to develop the latent image to provide a toner image;

a transfer roller configured to transfer the toner image onto a recording medium;

a heating roller having a heating surface;

a pressure roller configured to be in pressure contact with the heating roller;

a peeling claw having a tip end in contact with the heating surface of the heating roller;

a protection member configured to protect the peeling claw, the protection member comprising an opposing roller in confrontation with the peeling claw;

a drive shaft elongated in a direction and rotatably supported by the frame, the drive shaft having a first end and a second end, the opposing roller coaxially provided on the drive shaft; and a bearing disposed in an intermediate position between the first end and the second end to rotatably support the drive shaft.

2. The image forming device according to claim 1, further comprising:

a drive roller fixed to the drive shaft to be coaxially rotatable therewith; and a driven roller rotatable in association with rotations of the drive roller.

3. The image forming device according to claim 1, wherein two opposing rollers are disposed at a first position and a second position respectively, the first position being a mid-position between the first end and the intermediate position, the second position being a mid-position between the second end and the intermediate position; wherein four drive rollers are disposed at a third position, a fourth position, a fifth position and a sixth position respectively, the third position being between the first end and the first position, the fourth position being between the first position and the intermediate position, the fifth position being between the intermediate position and the second position, and the sixth position being between the second position and the second end; wherein two peeling claws are disposed in confrontation with the two opposing rollers respectively; and wherein four driven rollers are disposed in confrontation with the four drive rollers respectively.

4. The image forming device according to claim 2, wherein the driven roller and the peeling claw are disposed in positions offset from each other in the direction.

5. The image forming device according to claim 1, wherein the opposing roller is rotatable with respect to the drive shaft.

6. The image forming device according to claim 1, the tip end of the peeling claw is configured to be movable towards and away from the heating surface.

7. The image forming device according to claim 1, a projection of the peeling claw overlaps at least partially with a projection of the driven roller when the projections are on a plane perpendicular to the direction.

8. The image forming device according to claim 7, wherein the tip end of the peeling claw is configured to be movable towards and away from the heating surface, and the projection of the peeling claw overlaps at least partially with the projection of the driven roller when projected onto the plane perpendicular to the direction regardless of a position of the peeling claw.

* * * * *